US005443250A

United States Patent [19]

Gösslinghoff

[11] Patent Number: 5,443,250

[45] Date of Patent: Aug. 22, 1995

[54] METHOD AND APPARATUS FOR INSERTING OBJECTS INTO MULTI-SHEET PRODUCTS, PARTICULARLY PRINTED PRODUCTS

[75] Inventor: Reinhard Gösslinghoff, Kempten, Switzerland

[73] Assignee: Ferag AG, Hinwil, Switzerland

[21] Appl. No.: 87,654

[22] Filed: Jul. 6, 1993

[30] Foreign Application Priority Data

Jul. 6, 1992 [CH] Switzerland ..... 2123/92

[51] Int. Cl.[6] ..... B65H 5/30

[52] U.S. Cl. ..... 270/57

[58] Field of Search ..... 270/55, 57, 54

[56] References Cited

U.S. PATENT DOCUMENTS

| | | | |
|---|---|---|---|
| 2,570,916 | 10/1951 | Burls | 270/57 X |
| 2,625,392 | 1/1953 | Morrison | 270/57 |
| 3,561,751 | 2/1971 | Dutro | 270/57 X |
| 3,601,388 | 8/1971 | Hilliard | 270/54 |
| 3,692,301 | 9/1972 | Wetter | 270/55 |
| 3,722,877 | 3/1973 | Wetter . | |
| 3,951,399 | 4/1976 | Reist . | |
| 4,275,873 | 6/1981 | Rathert | 270/54 |
| 4,401,300 | 8/1983 | Morin | 270/55 |
| 4,420,146 | 12/1983 | Reist . | |
| 4,486,011 | 12/1984 | Rhunke . | |
| 4,526,356 | 7/1985 | Swint | 270/55 |
| 4,743,005 | 5/1988 | Reist . | |

FOREIGN PATENT DOCUMENTS

| | | | |
|---|---|---|---|
| 0080185 | 6/1983 | European Pat. Off. . | |
| 291617 | 12/1931 | Italy | 270/55 |
| 408970 | 9/1966 | Switzerland . | |
| 521911 | 6/1972 | Switzerland . | |
| 584153 | 1/1977 | Switzerland . | |
| 641113 | 2/1984 | Switzerland . | |
| 644815 | 8/1984 | Switzerland . | |
| 669944 | 4/1989 | Switzerland . | |

*Primary Examiner*—John E. Ryznic

*Attorney, Agent, or Firm*—Bell, Seltzer, Park & Gibson

[57] ABSTRACT

Multi-sheet products (D), particularly printed products, are opened, for example for the insertion of supplements. For this purpose, according to the method of the invention sheet edges, which in the closed product lie one on the other, are in a first step separated from each other so as to fan out by means of a gas current directed onto these edges, and in a second step an opener (71) is pushed between two of the fanned-out sheet edges, the edges being held stable in a separated position through the continuous action of the gas current until at least a part of the opener has been pushed between the sheets.

22 Claims, 5 Drawing Sheets

METHOD AND APPARATUS FOR INSERTING OBJECTS INTO MULTI-SHEET PRODUCTS, PARTICULARLY PRINTED PRODUCTS

BACKGROUND OF THE INVENTION

The invention relates to a method and an apparatus for the introduction of insertion objects into multi-sheet products, particularly into multi-sheet printed products.

A multi-sheet printed product consists of a plurality of sheets, for example rectangular sheets of paper, which (when the product is in the closed state) are joined together to form a stack and are held together in the region of one edge. Each of the sheets thus has an edge (fixed edge) which cannot be separated from the corresponding edges of other sheets and, for example, three edges (separable edges) which can be separated from the corresponding edges of the other sheets. A multi-sheet product is, for example, opened by pushing an opener between the sheets in such a manner that a number of sheets are turned, relative to another number of sheets or to the remainder of the sheets, about an axis parallel to the fixed edges of the sheets, such that two or more stacks of sheets are formed.

The fixed edges of multi-sheet printed products can be held together by for example one or more folds lying one in the other, binding, stitching or by a tool which is not part of the printed product and which holds the edges together temporarily. Newspapers, periodicals, books, brochures, sheets folded one into the other, or stacks of loose sheets temporarily held together are therefore all multi-sheet printed products.

Inserters are introduced for various purposes between the sheets of multi-sheet printed products. For example, openers are inserted in order to open the products, so that supplements can be pushed in. For this purpose sheet edges lying on one another in the closed product are usually first separated from each other at at least one point, in such a manner that a space, into which an opener is then inserted, is formed at least between two neighbouring sheets in the product and at least in the region of one of their separable edges. Through the insertion of the opener the sheets, or a part of them, are turned around the fixed edge, that is to say the printed product is opened and, if necessary, held in this open position.

It is advantageous for the edges to be separated, before the opener is inserted, at a point as far as possible from the fixed edge of the sheets.

If, for example, a supplement is to be inserted into the opened printed product, use is usually made of an opener provided with an insertion slot, the latter being disposed substantially parallel to the fixed edge of the multi-sheet printed product and the supplement being inserted through the insertion slot.

Various methods and devices are known for the insertion of openers into continuously conveyed multi-sheet products, particularly printed products, these methods and devices providing as a first step the separation of at least pact of the edges of the sheets and, as a second step, the insertion of the opener between the separated edges. Some of these methods and devices will be briefly recalled.

As an example, suction is applied, at a point distant from the fixed edges, to the upper side of multi-sheet printed products which are being conveyed in a horizontal position, in order to raise the uppermost sheet for an insertion operation. By this method multi-sheet printed products can be opened only between the uppermost sheet and the remainder of the sheets.

According to Swiss Patent Specification No. 584153 the sheets of a folded printed product are pressed together by a pressure member, so that the prestress produced in the sheets by the folding presses the separable sheet edges apart and thus an inserter can be pushed between them. The method can be applied only to folded products of a determined kind and the insertion object can be introduced only in the middle.

According to European Patent Specification No. 80185 products with prefold (sheets not folded exactly in the middle) or corresponding products having narrower and wider sheets are opened by buckling the wider sheets, so that they arch up against the narrower sheets and the latter consequently move apart, and thus the corresponding edges are separated and an opener can be introduced. This method can be applied only to products having sheets of different widths (for example with prefold) and sheets which can be deformed without being damaged. The product is always opened between the narrower and the wider sheets, so that a product with prefold is always opened in the middle.

According to Swiss Patent Specification No. 521911 a printed product, conveyed in a horizontal position with the fixed edges of the sheets at the rear (referring to the conveying direction), is opened by introducing from above a braking force which retards the top sheets relative to the bottom sheets and thus separates the corresponding edges, between which an opener can then be inserted. This method can also be used only for products whose sheets can be deformed without damage. A folded product is opened centrally by this method. In order to ensure opening at a determined different point, the corresponding sheets must be pretreated at the sides lying one on the other, so that their mutual friction is reduced.

The methods and apparatuses described are all restricted in use to multi-sheet products having determined properties and are suitable only for an insertion operation at a clearly defined point (for example in the middle). For the opening of multi-sheet products of any kind, without requiring pretreatment of the sheets while nevertheless permitting opening between any two predetermined sheets, the methods according to the two Swiss Patent Specifications Nos. 641113 and 644815 are available, both of them being based on the introduction of a pointed edge separator between sheet edges of the closed printed product which lie one on the other. In the first case the edge separator obstructs the movement of a number of sheets, which thus arch up at at least one point, whereby the other sheets are raised and thus deflected on an opener. In the second case a movement of the edge separator inserted between the sheets in order to separate the sheet edges separates a number of sheets from the other sheets, so that an opener can be inserted. In both cases the distance between the edge-separating point of the edge separator and the surface on which the printed product is supported defines the place where the printed product is opened.

The disadvantage common to these two methods consists in that the sheet edges lying one on the other are separated by the insertion of a pointed object, which can easily lead to damage to the sheets. Furthermore, depending on the quality of the finish of the product to be opened, the accuracy of insertion is more or less limited.

The problem underlying the invention is now that of indicating a method by which insertion objects, for example openers, can be introduced into multi-sheet products, particularly printed products, between any predeterminable sherbets. The method and apparatus should be applicable very largely irrespective of the type of connection between the fixed edges of the sheets (folding, stitching, binding, temporary fastening, and so on), very largely irrespective of the mechanical properties of the sheets (deformability, stiffness, friction), and very largely irrespective of the number of sheets contained in the product. In particular, the method should also be applicable to continuously conveyed products. The method should also make it possible for insertion objects to be introduced simultaneously at more than one point into products having a corresponding number of sheets. The apparatus to be provided for carrying out the method according to the invention should be simple and able to be integrated into existing equipment for the further processing of multi-sheet products in a more or less opened state, for example apparatuses for inserting supplements.

SUMMARY OF THE INVENTION

This problem is solved by the method and apparatus according to the present invention.

The main feature of the method according to the invention for the insertion of objects between the sheets of multi-sheet products, particularly between the sheets of multi-sheet printed products, at at least any one predeterminable point, consists in that for the separation of sheet edges, at least in one or more places, in a first step of the method a gas current, particularly an air current, is used instead of a mechanical instrument in the form of a pointed separator as used in the prior art. The air current is directed, substantially parallel to the surfaces of the sheets, towards an end face, formed by separable sheet edges lying one on the other, of the closed multi-sheet product. Because of the dynamic pressure caused by the impingement of the air current on the end face the sheet edges are separated from one another and, as long as the air current acts, they are stably held in this separated position by the air flowing into the resulting spaces between the sheets.

In a second step of the method an insertion object, for example an opener, is then pushed between the edges separated by the air current, so that the printed product is opened to a greater or lesser extent, for example in accordance with requirements for further processing, and is held open.

The method according to the invention is not restricted to the insertion of openers but, as will be further explained below, can be used for other objects which have to be inserted into multi-sheet products.

It is found that in the region in which the air current impinges on the end face of the multi-sheet product the separable sheet edges are individually fanned out. The more similar the sheets are to one another in their mechanical properties and in the quality of the edges which are to be separated, and the more uniformly the air jet acts over the entire thickness of the fanned-out product, the more regular this fanning will be, that is to say the more regular the resulting spaces between the separated sheet edges will be. The edges are more widely fanned out, the less the resistance of the sheets to the deformation (of deformable sheets) or the displacement (of stiff sheets) necessary for fanning out, and the more powerful the air current applied.

In order to make the fanning of the sheet edges as independent as possible of external influences and fluctuations in the power of the air current, it is advantageous to limit the fanning-out of the sheet edges on both sides with the aid of, for example, mechanical limiting means and to adjust the mean power of the air current in such a manner that the fanned-out edges regularly fill the space between the limiting means.

If the air current is limited in such a manner that it does not act on the entire thickness of the multi-sheet printed product, not all the sheet edges but only some of them will be fanned out, and in the extreme case only the edges of two neighbouring sheets.

The local fanning-out of the sheet edges by an air current directed against these sheet edges is possible, with practically any desired angles between the edges to be separated and the air current, as long as the latter acts substantially parallel to the main plane of the sheets of the closed product. Good results, with stable fanning-out, are for example achieved for continuously transported products if the air current is directed obliquely towards an end face of separable edges so that it forms an acute angle with the direction of transport of the products (no component oppositely to the direction of transport), and that from the end face on which it impinges it is directed via a separable corner of the sheets against another end face of separable sheet edges. In this way sheet corners and therefore two separable sheet edges are fanned out. Another advantage of edge separation in this way is that the air current impinges on the one end face of separable sheet edges, while an object to be inserted can be introduced between the sheets from another end face.

Less stable fanning out, which is therefore less practical for opening purposes, is achieved with an air current which is directed directly against a separable corner.

Since with a well-adjusted device practically equidistant fanning-out of the sheet edges can be achieved, it is possible, without further expedients, to push one or more elements, for example openers, between the sheet edges held apart by the air current in a second stage of the method, and thus to open the multi-sheet product at any one or more preselected places. Since the distance between the individual fanned-out sheet edges is considerably greater than the distance between the sheet edges of the closed product, by the method according to the invention it is possible, with considerably greater certainty, to insert the element accurately between two predetermined sheets than is possible by insertion into the closed product (prior art).

Since the affected edges of all the sheets of the product can be separated from one another by the air current, it is simple and expedient to insert a plurality of objects, if necessary, simultaneously between the separated sheet edges and in that way to open the product, for example, simultaneously in different places. In the same way it is also possible with the method according to the invention for products transported, for example, in pairs or groups of three or more copies to be opened simultaneously.

Another advantage of the method according to the invention consists in that the sheet edges do not have to be manipulated mechanically for the separation, so that it can also be used for high-quality products of sensitive material.

BRIEF DESCRIPTION OF THE DRAWINGS

The objects and advantages of the invention will now be described in further detail with reference to the schematic drawings, in which.

DETAILED DESCRIPTION OF THE PREFERRED EMBODIMENTS

The drawings illustrate the method according to the invention in one application given as an example. This application is the insertion of an opener into multi-sheet printed products in order to open them for the insertion of supplements. For this purpose the printed products are usually conveyed in a channel having a V-shaped or U-shaped cross-section, with the spine or fold (fixed edges of the sheets) against the apex line of the channel, and while being conveyed are opened and held open for the insertion. Depending on the position of the channel in space, the product can or must be held fast in the region of the spine or fold.

Figure 1:
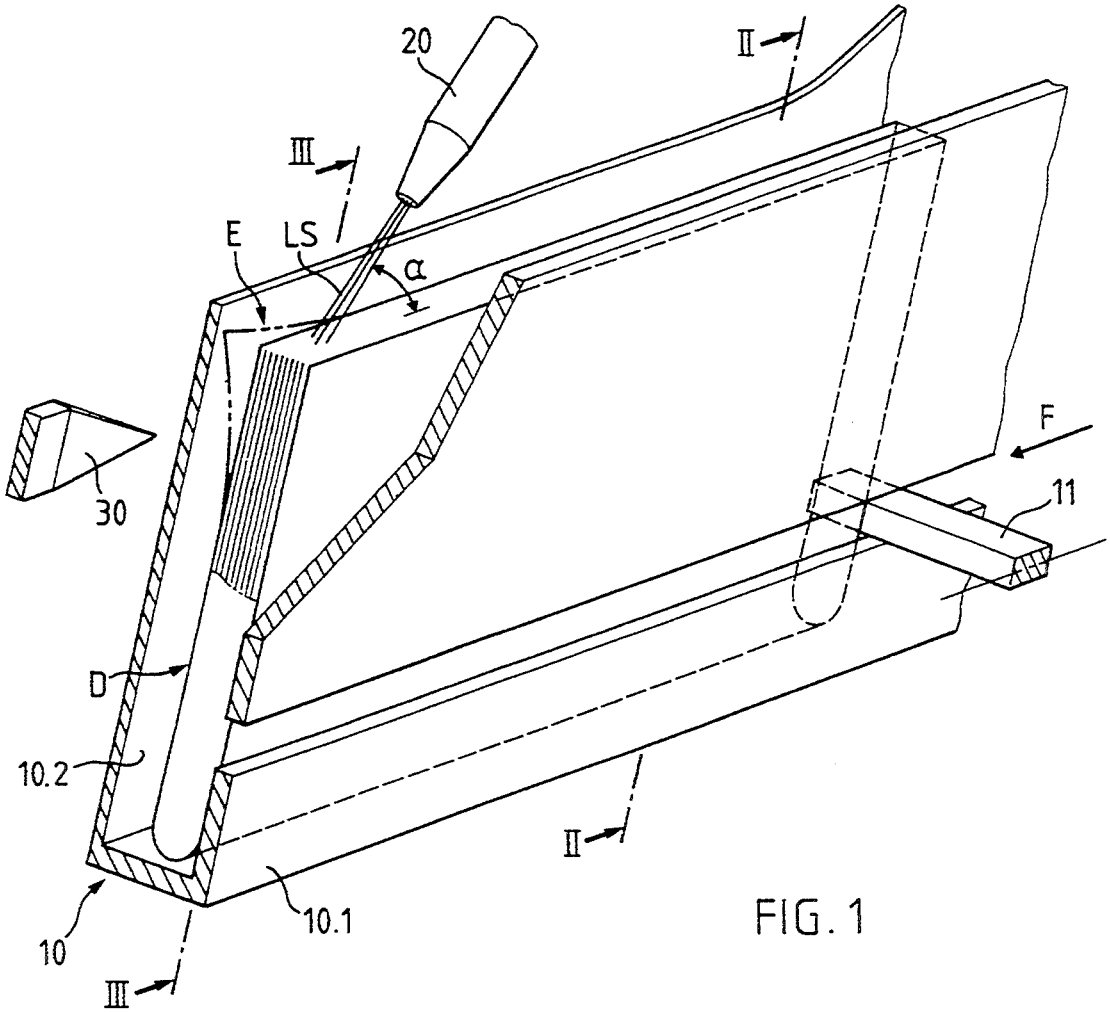
FIG. 1 is a perspective view illustrating one embodiment of the present invention.

Another example of an application (not illustrated) of the method of the invention consists in that the insertion object, which is pushed between the sheets of the multi-sheet product, is itself the product to be inserted. This means, in other words, that the sheet edges are fanned out by an air current and an insert product is introduced between the sheet edges held in a fanned-out position by the air current, without the multi-sheet product being opened with the aid of an opener. This application of the method according to the invention is above all conceivable for the insertion of thin insert products of relatively small size, such as for example the insertion of individual postcards. FIG. 1 illustrates the principle of the method of the invention, in a three-dimensional representation, for the first, abovementioned application given as an example. The figure shows as an example a printed product D consisting of a multiplicity of sheets folded one in the other, disposed in a U-shaped channel 10 having two side walls 10.1 and 10.2. The printed product D is for example conveyed by a slider 11, which moves along the channel 10, in the conveying direction (arrow F). Against the end face of the printed product opposite the fold a nozzle 20, through which an air current LS flows towards the printed product, is disposed at an acute angle $\alpha$ to the conveying direction F and substantially parallel to the main planes of the sheets of the closed product D. The air current LS fans out the separable sheet edges of the printed product in the region of the corner E lying at the front in the conveying direction F, that is to say it fans out the sheet edges on both sides of the corner E. In front of the nozzle 20, referring to the conveying direction, and at a distance therefrom an opener 30 is disposed in a fixed position in such a manner that at a predetermined point it is pushed between the fanned-out sheet edges as the conveying of the product continues.

It is advantageous for the channel to be so disposed (not symmetrically to a vertical plane) for the opening operation that the closed printed product D lies on one of its walls and therefore assumes a defined position when the air current impinges on its end face. At the same time the printed product may also be held in the channel in the region of the fold.

Figure 2:
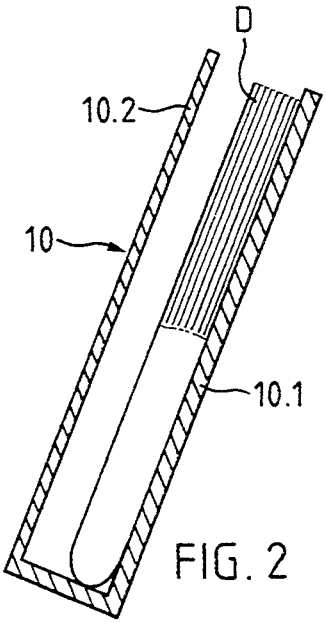
FIG. 2 is a section view taken along the line II—II of FIG. 1 and through the multi-sheet product at a location beyond the action of the air current which separates the sheet edges.
Figure 3:
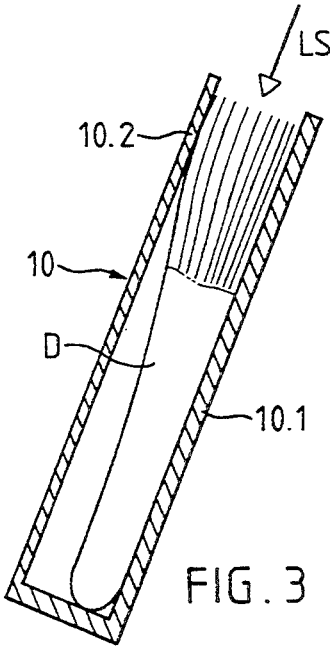
FIG. 3 is a section view taken along the line III—III of FIG. 1 and through the multi-sheet product at the location of the action of the air current which separates the sheet edges.

It is obviously also possible not to move the printed product towards the opener, but conversely to move the opener towards the printed product, while in both cases the movement must be synchronised with the control of the air current in such a manner that when the opener impinges the end face of the printed product the sheet edges are stably and regularly fanned out at the point in question. As FIGS. 2 and 3 show, the two side walls 10.1 and 10.2 of the channel 10 serve at the same time as limiting means for the fanning-out of the sheet edges. FIG. 2 shows a section at right angles to the conveying direction F (sectional line II in FIG. 1) through a part of the channel at a point where the sheet edges are not fanned out, that is to say for example in the region of the sheet corners at the rear in the conveying direction. In the closed state the printed product here lies against one side wall 10.1 of the channel. FIG. 3 shows a corresponding section (sectional line III in FIG. 1) through the channel 10 and the product D in a region where the sheet edges are fanned out. The sheet edges are distributed substantially equidistantly over the space available between the side walls 10.1 and 10.2. Irrespective of the power of the air current LS acting, the sheet edges cannot be fanned out to a greater extent than is achieved when they occupy the entire space between the side walls of the channel. An opener introduced, for example, centrally between the two walls will open every product in the middle.

Figure 4:
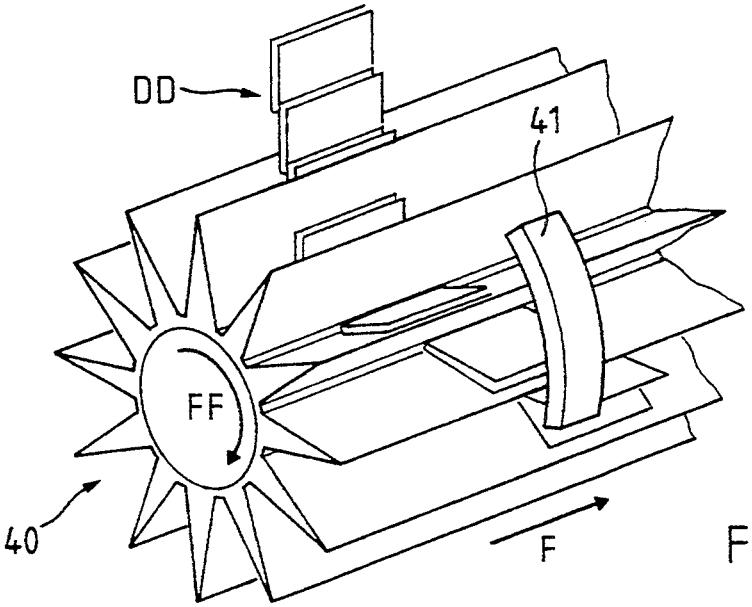
FIG. 4 is a perspective view of an insertion drum equipped fox carrying out the method according to the invention.
Figure 5:
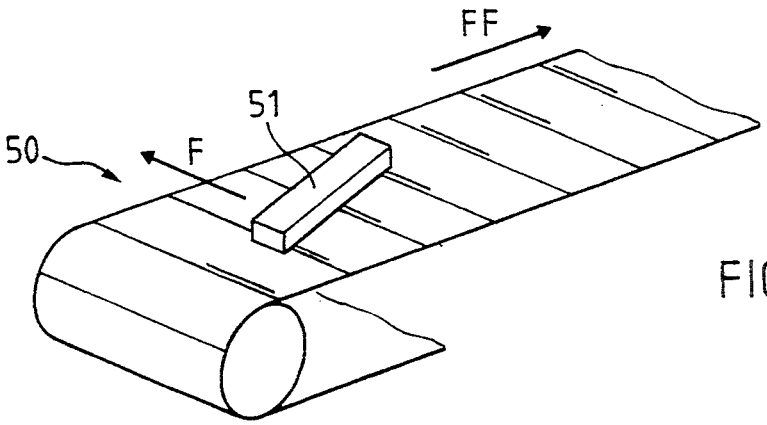
FIG. 5 shows another insertion device equipped for carrying out the method according to the invention.

FIGS. 4 and 5 now show insertion devices utilising the method of the invention for the insertion of an opener for opening multi-sheet products, particularly printed products, which are conveyed in a V-shaped or U-shaped channel.

FIG. 4 illustrates schematically an insertion drum 40, such as is described, for example, in Swiss Patent Specification No. 584153. Multi-sheet printed products DD are continuously introduced, singly or in groups, into the compartments of the rotating drum 40 and during a first rotation (conveying direction FF) are conveyed in the compartments, which essentially correspond to the channel in FIGS. 1 to 3, in the direction of the axis of the drum (conveying direction F) and at the same time opened, that is to say are carried into the region of a stationary opener (not shown). For the purpose of separating the sheet edges with the aid of an air current in accordance with the invention, before and during the insertion of the opener, a row of nozzles or a single slot-shaped nozzle 41 is disposed over one region of the drum, such that the printed products, which not only rotate with the drum 40 (conveying direction FF) but are also conveyed in the axial direction (conveying direction F), are truck by as uniform as possible an air current, always at the same place, during the predetermined period of time. The action of the air current on the end faces of the printed products must start before they encounter the opener, namely so long a time before that encounter that stable fanning-out of the sheet edges or sheet corners can be achieved before the opener is pushed between the sheets. As soon as only a small part of the opener (or openers) is situated between the sheets, the action of the air current can stop.

Figure 7:
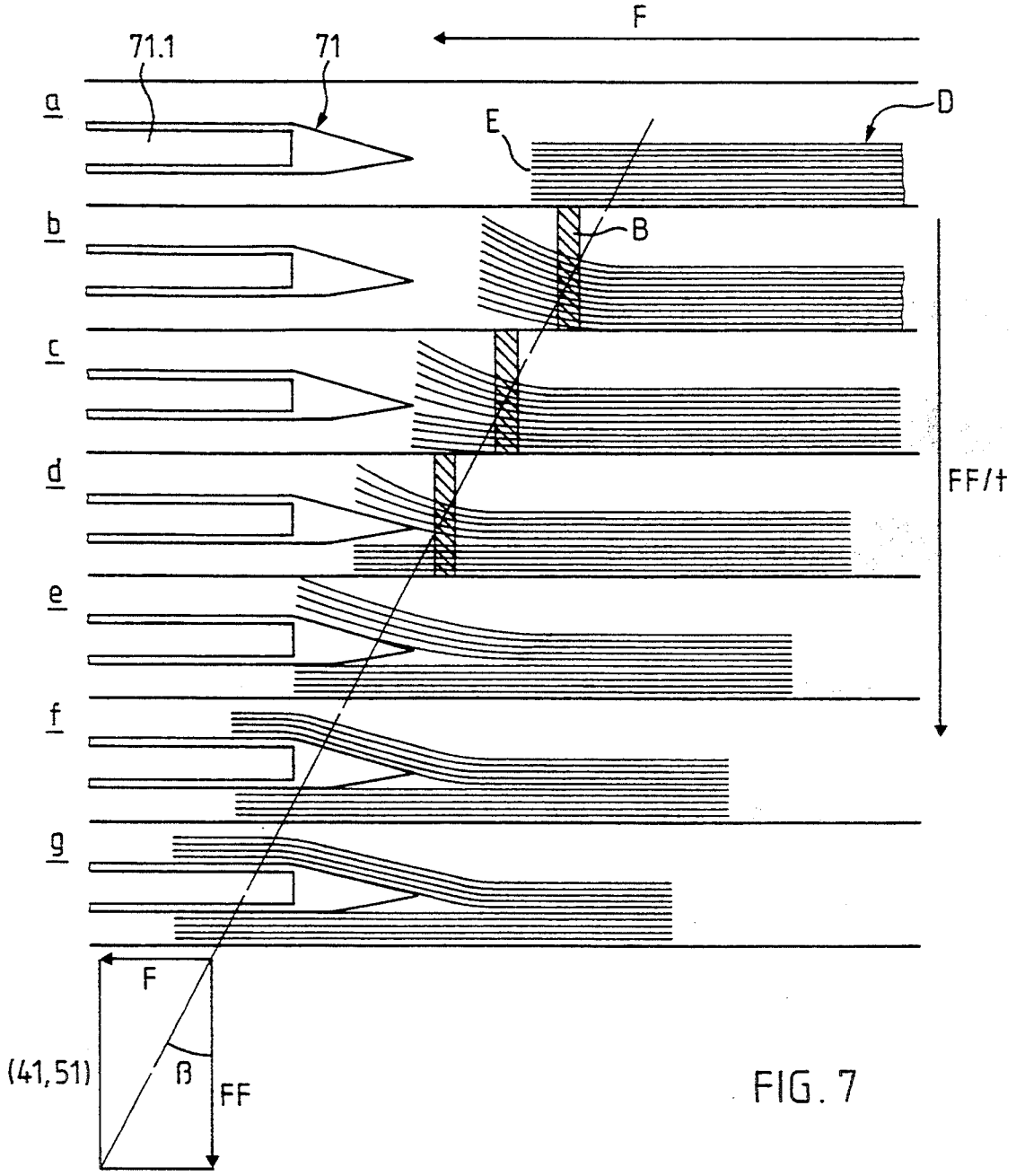
FIG. 7 illustrates the method according to the invention in the form of a time or place sequence.

For stable fanning-out of the sheet edges or sheet corners it is advantageous for the nozzle to be disposed above the spiral movement path of the printed products in such a manner that during the time when the air current is in action it always impinges on the same region of the end face (in this connection see also FIG. 7 and the corresponding description).

FIG. 5 shows schematically an insertion track 50 for insertion purposes, such as is described for example in Swiss Patent Specification No. 669944. The difference from the insertion drum is that the compartments containing the multi-sheet printed products do not rotate with a drum, but are moved by corresponding conveyor means over a substantially rectilinear conveyor path (conveying direction FF). During this conveying the printed products are likewise moved (conveying direction F), inside the compartments, at right angles to the conveying direction FF, and at the same time opened. In a system of this kind the method according to the invention can also be used to advantage. For this purpose a row of nozzles or a corresponding slot-shaped nozzle 51 is disposed once again above the compartments, such that the air current for fanning out the sheet edges or sheet corners and introducing the opener or openers acts continuously on the same part of the end face of the printed products, which are conveyed both in the conveying direction FF together with the compartments and also transversely thereto (conveying direction F) in the compartments. In order to achieve this the row of nozzles or the slot-shaped nozzle 51 should here again be disposed at an angle to the conveying direction FF (see also FIG. 7 and the relative description).

Figure 6:
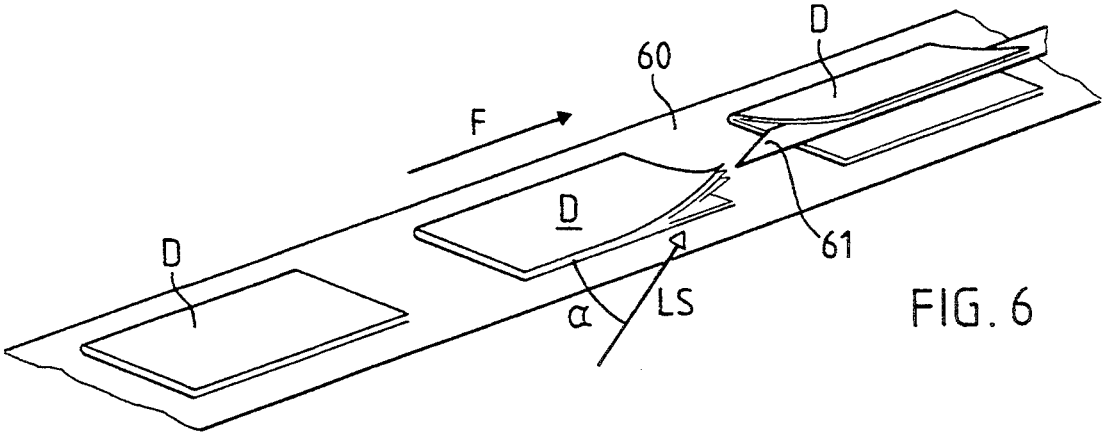
FIG. 6 illustrates the method according to the invention, carried out on products transported in a horizontal positions.

FIG. 6 further shows an apparatus in which the multi-sheet products D are conveyed in the conveying direction F while lying one behind the other on a conveyor support 60, for example with the fixed edges of the sheets aligned parallel to the conveying direction F. The air current LS acts substantially parallel to the conveyor support 60 and at an angle $\alpha$, which is smaller than 90°, to the conveying direction F, on that end face of the printed products which lies parallel to the conveying direction F and is formed by separable sheet edges. The nozzle (not shown) may be stationary, given an appropriately great distance between the products (as illustrated), or may be moved together with each product during the necessary period of time during which the sheet edges or sheet corners are fanned out and held open for the insertion of an opener 61, for example.

FIG. 7 now shows in detail, with a viewing angle into the opening of the compartments, the course of the opening process in accordance with the invention, for example in the compartments of an insertion drum as shown in FIG. 4, or in the compartments of a insertion track according to FIG. 5. FIG. 7 can be regarded as the illustration of a number of successive compartments containing printed products conveyed in the conveying directions F and FF, or as the time sequence of the process in one compartment (conveying direction F and time axis t). In the time sequence form this figure can also be understood as an illustration of the process in a single channel in which printed products are conveyed in linear succession, similarly to the case shown in FIG. 6.

The multi-sheet product in compartment a lies in the closed form against one of the compartment walls. In the conveying direction F it approaches a stationary opener 71 provided with an insertion slot 71.1. The front corner E (referring to the conveying direction F) of the printed product D is fanned out in the compartment b by an air current directed onto the end face of the product in the region B. The printed product in compartment c strikes by its fanned-out corner E against the opener 71, which, depending on its distance from the two walls of the compartment, is inserted between a determined pair of the fanned-out sheet edges (compartment d). In order to keep the fanning-out of the sheet corners stable, it is advantageous for the end face region B on which the air current impinges to remain unchanged, as illustrated, that is to say to dispose the row of nozzles (41, 51), as already mentioned in connection with FIGS. 4 and 5, on the path of movement of the printed products, this path being obtained as the resultant of the two conveying directions (F and FF) and the corresponding speeds.

For arrangements in which the openers are stationary, and in which the printed products are conveyed both in the direction FF and in the direction F, an arrangement of the nozzles with an angle $\beta$ to the conveying direction FF, as illustrated, is obtained. For an arrangement with movable openers, in which the printed products are conveyed only in the direction FF, an arrangement of the nozzle parallel to FF is obtained.

In compartments e to g fanning-out is no longer required. The opener is pushed between the sheets of the printed product and opens the latter. When the printed product has been completely opened (not illustrated), a supplement can be inserted into the opened printed product by the insertion slot 71.1 of the opener 71.

It is obvious that instead of conveying the printed products in the direction F it is also possible to move the openers in the opposite direction while the printed products are conveyed, together with the compartments, only in the conveying direction FF.

Multi-sheet products can be opened by the method according to the invention not only in order to insert supplements, but also for any manipulations to be carried out between two sheets.

An air jet acting on the end face regions designated B in the printed products can be obtained with a row of nozzles disposed on a corresponding line, or with a corresponding slot-shaped nozzle. The air may flow continuously or correspondingly discontinuously (pulsatingly) from the nozzle or nozzles.

In all the cases of application illustrated (except FIG. 6) the fanning-out of the sheet edges or sheet corners is limited by the two compartment walls.

In the form of construction of these walls which is illustrated in FIG. 7 the fanning-out is such that an outermost sheet of the multi-sheet product substantially retains its position.

Figure 8:
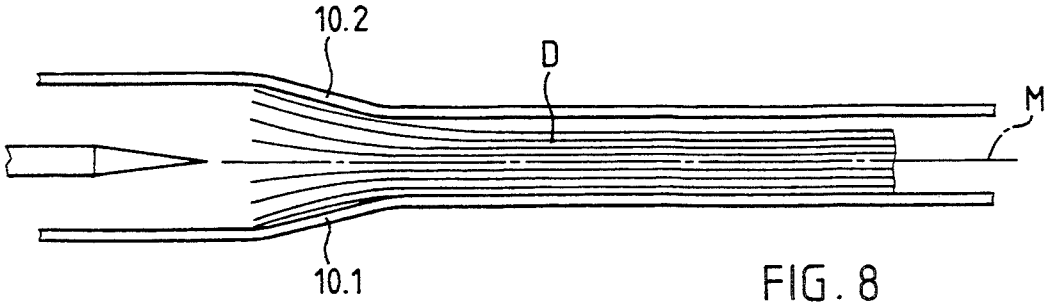
FIG. 8 shows limiting means for fanning out the sheet edges symmetrically.

FIG. 8, on the other hand, shows examples of arrangements in which the wall 10.1, against which the product lies in the closed state, is so constructed in the region where the air current acts that the sheet edges or sheet corners are fanned out in such a manner that the middle sheets substantially retain their position. The coacting wall 10.2, which is shaped symmetrically to the wall 10.1 in relation to a centre plane M of the conveyor channel, likewise contributes towards this effect.

It is also conceivable to limit the fanning-out adjustably with regulable air currents directed against the outermost sheets of the printed products. The width of the fanning-out can in such a case be adjusted by the adjustable ratio of the powers of the fanning-out and limiting air currents. The place where an insertion object is inserted into the product can be determined by the likewise adjustable ratio of the powers of the two limiting air currents.

Figure 9:
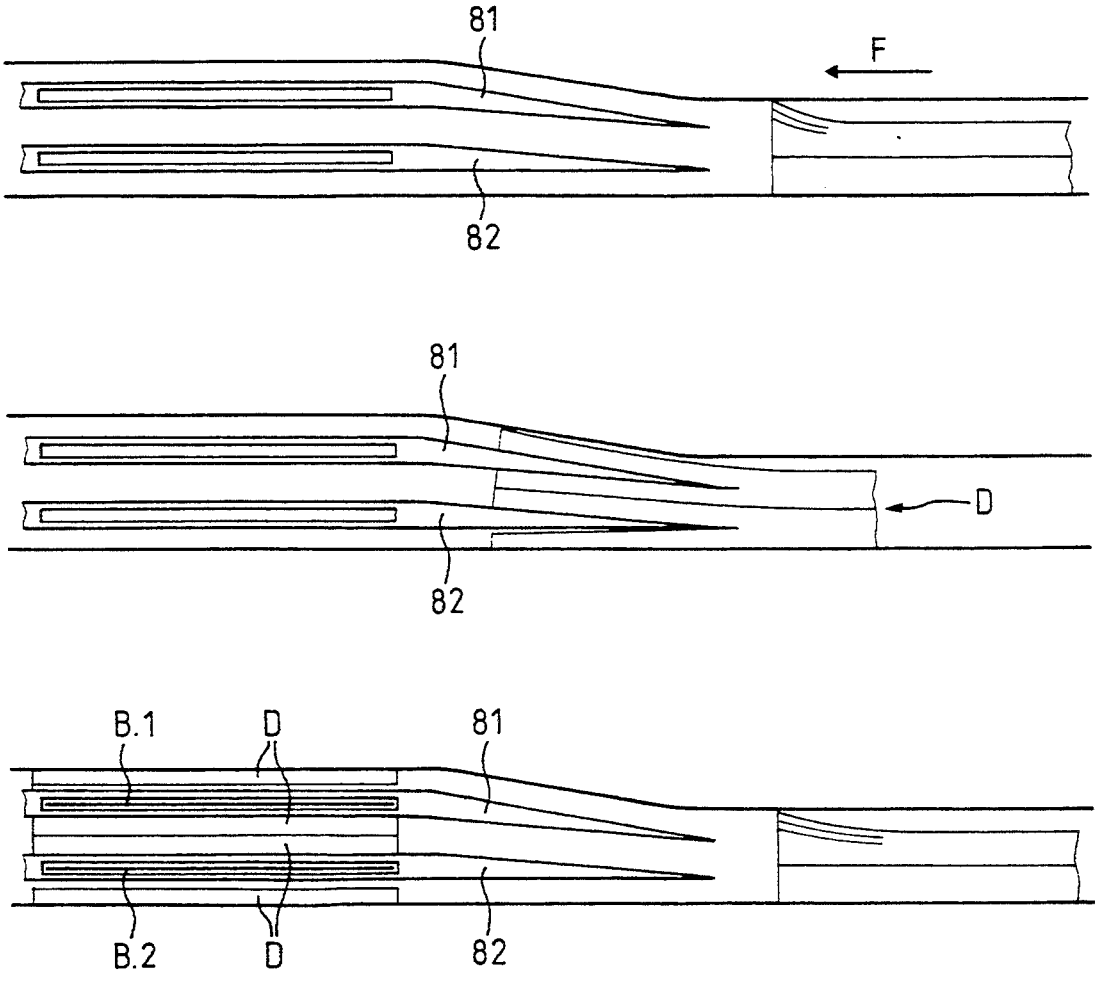
FIG. 9 shows the cycle of the method according to the invention for simultaneously opening products transported in pairs or groups.

FIG. 9 illustrates in similar fashion to FIG. 7 the application of the method according to the invention to the simultaneous opening of two printed products conveyed as a pair, or to the simultaneous opening of a correspondingly thick product in two places. The method is carried out in an exactly analogous manner, two (or correspondingly more than two) openers 81 and 82 being used. As shown in FIG. 9, two for example different supplements B.1 and B.2 can then be inserted into the opened products or the doubly opened product at the same place.

Figure 10:
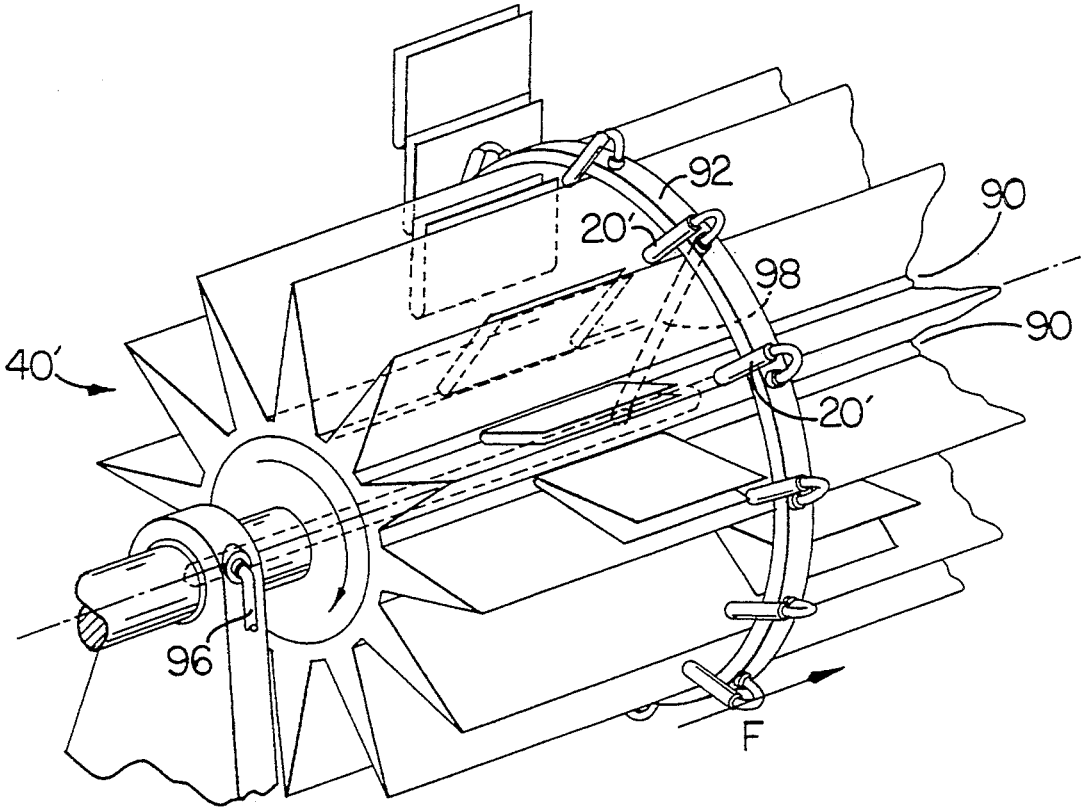
FIG. 10 is a view similar to FIG. 4, and further illustrating a nozzle system which moves together with the compartments over the insertion path.

FIG. 10 illustrates a rotating insertion drum 40' of the type described above with respect to FIG. 4, and which comprises a plurality of compartments 90 which open in a radial direction and extend in an axial direction. Each compartment 90 defines a path of travel for the multi-sheet products which advance axially therealong. Also, a nozzle 20' is provided for each compartment 90 and which moves together with the compartment over the insertion path. More particularly, the drum 40' includes a ring 92 attached to the walls of the drum, with an air nozzle 20' attached to the ring 92 above each compartment. Air is supplied to the nozzles via an air supply duct 96 which extends through the axle of the drum and to a radial duct 98 leading to the ring 92.

I claim:

1. An apparatus for inserting insertion objects between the sheets of multi-sheet products, comprising means for supporting and sequentially advancing the multi-sheet products along a path of travel with the products being in a closed state and so that the products each define an end face, nozzle means positioned along the path of travel for directing a gas current (LS) in a direction substantially parallel to the surfaces of the sheets and against the end face of each product, so as to separate at least two neighboring sheets from each other in at least one location, and means for relatively moving at least one insertion object and each of the advancing products so that the insertion object is pushed between the separated sheets of each product.

2. The apparatus according to claim 1 wherein the nozzle is disposed so that the gas current (LS) fans out separable sheet corners.

3. The apparatus according to claim 1 wherein the insertion object is an opener (30, 61, 71, 81/82) and has a configuration such that it opens the multi-sheet product at one or more predetermined places.

4. The apparatus according to claim 1 wherein the insertion object comprises a product supplement to be inserted into the multi-sheet product.

5. The apparatus according to claim 1 wherein the nozzle means comprises at least one nozzle which defines an elongate outlet which is disposed in a direction parallel to the path of travel of the products.

6. The apparatus as defined in claim 1 wherein the supporting and advancing means comprises a rotating drum composed of a plurality of compartments which open in a radial direction and extend in an axial direction, and wherein each compartment defines a path of travel for the advancing multi-sheet products.

7. The apparatus as defined in claim 6 wherein each compartment is provided with a nozzle (20) which moves together with the compartment over the path of travel of the multi-sheet products.

8. A method for inserting insertion objects between the sheets of multi-sheet products (D), comprising a first method step in which at least two sheet edges, lying one on the other when the product is in the closed state, of two neighboring sheets are separated from one another at least in one or more places, and a second method step in which the insertion object is pushed between the separated sheet edges, characterized in that said first method step includes directing a gas current (LS) substantially parallel to the main planes of the sheets, towards an end face,, formed by separable sheet edges lying one on the other, of the closed product, and said second method step includes introducing an insertion object between two sheet edges which are held separated by the gas current.

9. Method according to claim 8, characterised in that the insertion object introduced between the sheets in the second step of the method is an insert.

10. Method according to claim 8, characterised in that the insertion object inserted between the sheets in the second step of the method is an opener (30, 61, 71, 81/82) by which the multi-sheet product is opened.

11. Method according to claim 8, characterised in that the sheet edges are held separated by a continuous action of the gas current (LS) until the insertion object has been at least partly inserted between two sheets of the product.

12. Method according to claim 8, characterised in that the insertion object is inserted, by corresponding arrangement in position, between two predetermined sheets of the multi-sheet product.

13. Method according to claim 8, characterised in that in the region of the sheet corners (E) formed by first and second separable sheet edges the gas current (LS) is directed obliquely onto the end face, formed by the first sheet edges, of the multi-sheet product (D) in such a manner that the first and second sheet edges are separated, and in that the insertion object is pushed between two sheets in the region of the second sheet edges separated by the gas current (LS).

14. Method according to claim 8, characterised in that the gas current (LS) is directed onto an end face of the product (D) lying substantially parallel to a conveying direction (F) in which the product is continuously conveyed, in such a manner that an acute angle ($\alpha$) is formed between the direction of flow of the gas current and the direction (F) in which the product is conveyed.

15. Method according to claim 8, characterised in that the gas current (LS) is directed onto a multi-sheet product end face disposed substantially parallel to a direction of movement in which the insertion object is moved towards the product.

16. Method according to claims 8, characterised in that during the two steps of the method the multi-sheet product (D) is disposed, at least in the region of the sheet edges which are to be separated by the gas current, between two limiting means limiting the fanning-out of the sheet edges.

17. Method according to claim 16, characterised in that the limiting means are walls (10.1 and 10.2) of a channel-shaped compartment (10).

18. Method according to claim 16, characterised in that the limiting means are gas currents the power of which is adjustable and which are directed against the outermost sheets of the multi-sheet product.

19. Method according to claim 8, characterised in that the gas current (LS) remains continuously directed onto the same place (B) of an end face of the multi-sheet product throughout the period of time necessary for the two steps of the method.

20. Method according to claim 8, characterised in that in the second step of the method one or more further insertion objects (82) are inserted, parallel to the insertion object (81), between in each case two sheets of the multi-sheet product.

21. Method according to claim 8, characterised in that the multi-sheet product consists of at least two multi-sheet printed products lying one on the other, and in that in the second step of the method at least one insertion object (81, 82) is inserted into each of the printed products.

22. Use of the method according to claim 8 for inserting supplements into multi-sheet printed products.

* * * * *